US008731435B2

(12) United States Patent
Xu

(10) Patent No.: US 8,731,435 B2
(45) Date of Patent: May 20, 2014

(54) PROCESS CARTRIDGE FOR AN IMAGING DEVICE

(71) Applicant: Jiangxi YiBo E-TECH Co., Ltd., Jiangxi (CN)

(72) Inventor: Jun Xu, Jiangxi (CN)

(73) Assignee: Jiangxi Yibo E-TECH Co., Ltd., Jiangxi (CN)

( * ) Notice: Subject to any disclaimer, the term of this patent is extended or adjusted under 35 U.S.C. 154(b) by 99 days.

(21) Appl. No.: 13/650,293

(22) Filed: Oct. 12, 2012

(65) Prior Publication Data

US 2013/0136492 A1 May 30, 2013

(30) Foreign Application Priority Data

Nov. 26, 2011 (CN) ..... 2011 1 0394455

(51) Int. Cl.
*G03G 21/16* (2006.01)
*G03G 21/18* (2006.01)

(52) U.S. Cl.
CPC ..... *G03G 21/185* (2013.01)
USPC ..... 399/111

(58) Field of Classification Search
CPC ..... G03G 21/185
USPC ..... 399/110, 111
See application file for complete search history.

(56) References Cited

U.S. PATENT DOCUMENTS

| | | | | |
|---|---|---|---|---|
| 4,065,941 | A | 1/1978 | Aoki | |
| 4,439,257 | A | 3/1984 | Sato et al. | |
| 4,829,335 | A | 5/1989 | Kanemitsu et al. | |
| 5,168,319 | A | 12/1992 | Kimura et al. | |
| 5,331,373 | A | 7/1994 | Nomura et al. | |
| 5,452,056 | A | 9/1995 | Nomura et al. | |
| 5,463,446 | A | 10/1995 | Watanabe et al. | |
| 5,583,630 | A | 12/1996 | Kimura et al. | |
| 8,280,278 | B2 * | 10/2012 | Ueno et al. | 399/111 |

* cited by examiner

*Primary Examiner* — Walter L Lindsay, Jr.
*Assistant Examiner* — Frederick Wenderoth
(74) *Attorney, Agent, or Firm* — Pearne & Gordon LLP

(57) ABSTRACT

A cartridge that can be detachably installed within an imaging device, which includes a cartridge casing, a photosensitive drum driving assembly located on the casing, and a control mechanism for controlling extension and retraction of a force receiving head in the photosensitive drum driving assembly. The control mechanism includes a control rod, which can rotate around a pivot on the cartridge casing, and a elastic means mounted on the control rod. The cartridge of the invention uses a control mechanism to control extension and retraction of the force receiving head in the photosensitive drum driving assembly, and as a result when the cartridge is removed of the imaging device, the force receiving head does not become stuck by a driving head of the imaging device.

13 Claims, 6 Drawing Sheets

PARTIAL ENLARGED VIEW OF PART B

PROCESS CARTRIDGE FOR AN IMAGING DEVICE

FIELD OF THE INVENTION

The invention relates to a process cartridge used in an imaging forming device.

BACKGROUND OF THE INVENTION

A process cartridge for an imaging device can be detachably installed within a main body of the imaging device and, as a whole unit, comprises a photosensitive assembly and at least one processing means such as charging means, developing means, cleaning means, or the like. The cartridge is detachably installed within the main body of the imaging device for convenience of maintenance. An electrophotographic imaging device functions in the following manner: an electrostatic latent image is formed by selectively exposing the electrophotographic photosensitive assembly which is uniformly charged by a charger under light from the imaging device; the electrostatic latent image is developed with a developing means using a toner into a toner image; the toner image thus formed is transferred onto a recording medium by a transferring means to form an image on a recording material.

Generally, a photosensitive drum driving assembly is provided at one end of the cartridge for receiving a driving force from the imaging device. A conventional cartridge uses a universal joint driving head connection structure for its photosensitive drum. When the cartridge is taken out of the imaging device, the universal joint driving head is leaned and removed from a driving head of the imaging device. This connection structure has a disadvantage that the universal joint driving head is prone to be stuck with the driving head of the imaging device when the cartridge is taken out of the imaging device. As a result, the process cartridge cannot be conveniently removed from the imaging device.

SUMMARY OF THE INVENTION

The present invention provides a reliable and stable cartridge for an imaging device so as to solve the above-mentioned problem.

Specifically, in order to solve this problem, the invention provides:

A process cartridge detachably attached to an imaging device comprises a cartridge casing, a photosensitive drum driving assembly located on the casing, and a control mechanism for controlling extension and retraction of a force receiving head in the photosensitive drum driving assembly, wherein the control mechanism includes a control rod, which can rotate around a pivot on the cartridge casing, and a elastic means mounted on the control rod.

The pivot may be a positioning column arranged on a side wall of the cartridge casing. The control rod may be provided with a positioning hole matching the positioning column.

The pivot may be a positioning hole arranged in a side wall of the cartridge casing. The control rod may be provided with a positioning column matching the locating hole.

The control rod may be provided with a biasing portion for coupling the force receiving head and a control portion for coupling with a restraining portion on an inner wall of the imaging device.

The force receiving head may be provided with a slanting surface. The biasing portion may be provided with a biasing surface for imposing a biasing force on the slanting surface.

The two ends of the elastic element may be respectively mounted on a column on the control rod and a column on the cartridge casing.

The elastic means is a compression spring.

As discussed above, the cartridge of the present invention is provided with the control mechanism. Thus when the process cartridge is moved in or out of the imaging device, the restraining portion on the inner wall of the imaging device may force the control portion on the control mechanism, so that the biasing surface located on the biasing portion of the control rod may couple the slanting surface of the force receiving head. The coupling between the two surfaces may produce an axial force that drives the force receiving head to retract. This will effectively lead to joining or separation of the force receiving head and the driving head of the imaging device. The cartridge can therefore be conveniently installed into or removed from the imaging device.

DESCRIPTION OF THE PREFERRED EMBODIMENTS

With reference to the accompanying drawings of the specification and specific embodiment, the invention will be described in detail below. It should be understood that the specific embodiments described below only serve to illustrate the present invention, but are not meant to limit the scope of the present invention.

Figure 1:
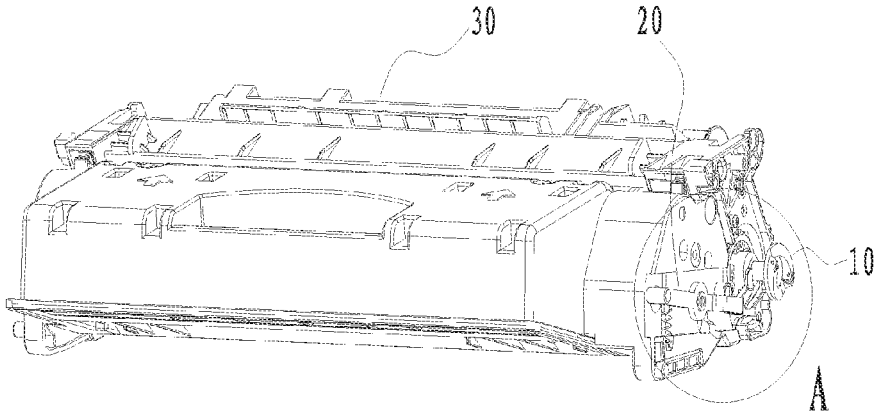
FIG. 1 is a prospective view of a cartridge according to one embodiment of the present invention before it is installed in an imaging device.
Figure 2:
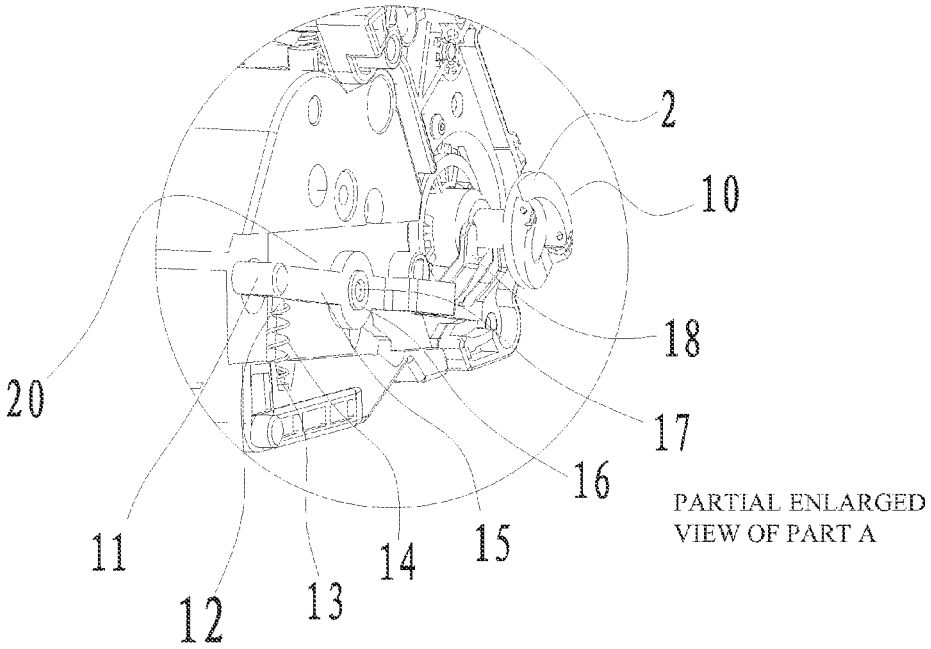
FIG. 2 is a partial enlarged view of part A as shown in FIG. 1.
Figure 3:
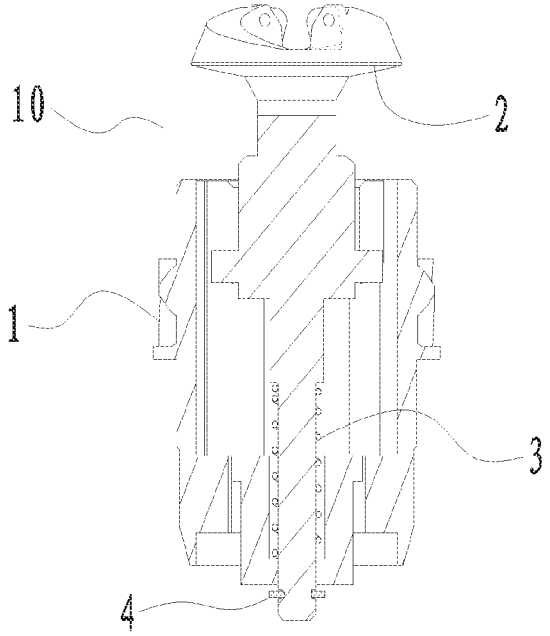
FIG. 3 is a section view of a photosensitive drum driving assembly before the cartridge is installed in the imaging device.

As shown in FIG. 1 to FIG. 3, the invention provides a cartridge comprising a cartridge casing 30, a photosensitive drum driving assembly 10 located on a side wall of the cartridge casing, and a control mechanism 20 for controlling extension and retraction of a force receiving head 2 in the photosensitive drum driving assembly 10.

As shown in FIG. 1 and FIG. 2, the control mechanism 20 includes: a control rod 15, which can rotate around a pivot on the casing of the cartridge and a first biasing means 14. In the present embodiment, the pivot of the cartridge casing is a positioning column 16 arranged on a side wall of the cartridge casing. The control rod 15 is provided with: a positioning hole 17 matching the positioning column 16 on the side wall of the cartridge casing; a biasing portion 18 for coupling the force receiving head 2; and a control portion 11 coupling a restraining portion 51 on an inner wall of the imaging device when the cartridge is being removed from the imaging device. The control rod 15 is further provided with a column 12 for positioning the first biasing means 14, wherein one end of the first biasing means 14 is mounted on the column 12 on the control rod and the other end is mounted on a column 13 on the cartridge casing. In an embodiment according to the present invention, the first biasing means 14 is a compression spring.

As shown in FIG. 3, the photosensitive drum driving assembly 10 includes: a force receiving head 2 for receiving force from a driving head of the imaging device; a drum gear 1 and a second biasing means 3, which may be a compressing spring or the like, located between the force receiving head 2 and the drum gear 1, wherein the force receiving head 2 can move back and forth along an axial direction of the drum gear 1 controlled by the second biasing means 3. The photosensitive drum driving assembly 10 further includes a limiting element 4 for limiting the location of the force receiving head 2 along the axial direction.

Figure 4:
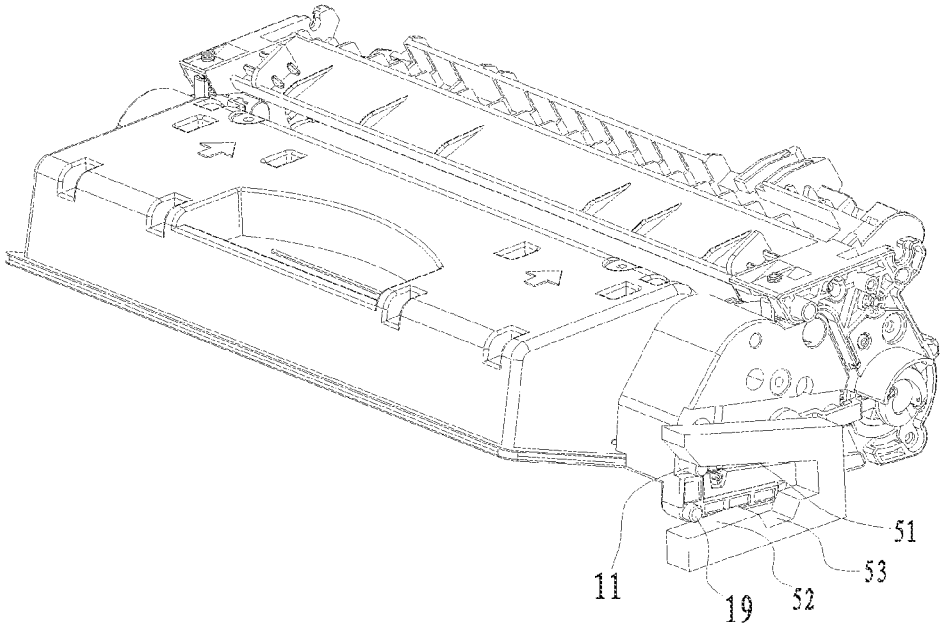
FIG. 4 is a schematic diagram showing the joining of the control mechanism of the cartridge and a restraining part on an inner wall of the imaging device when the cartridge is being installed into the imaging device.
Figure 5:
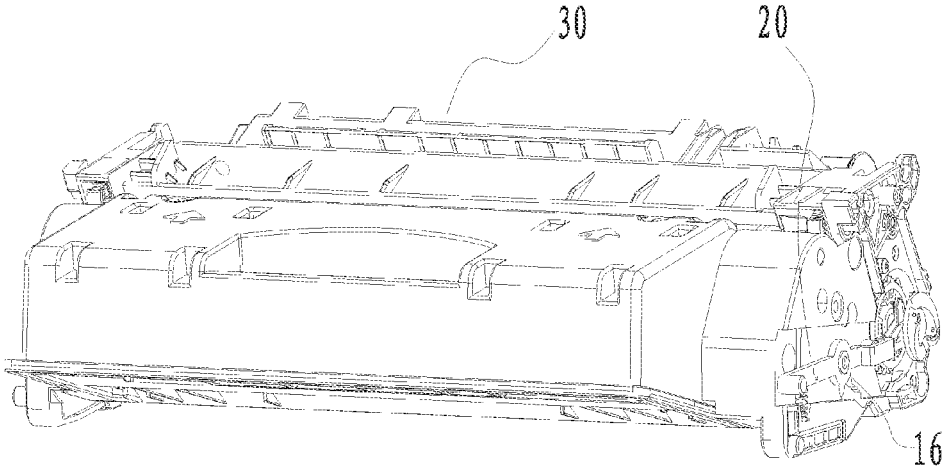
FIG. 5 is a schematic diagram showing the control mechanism when the cartridge is installed in the imaging device.
Figure 6:
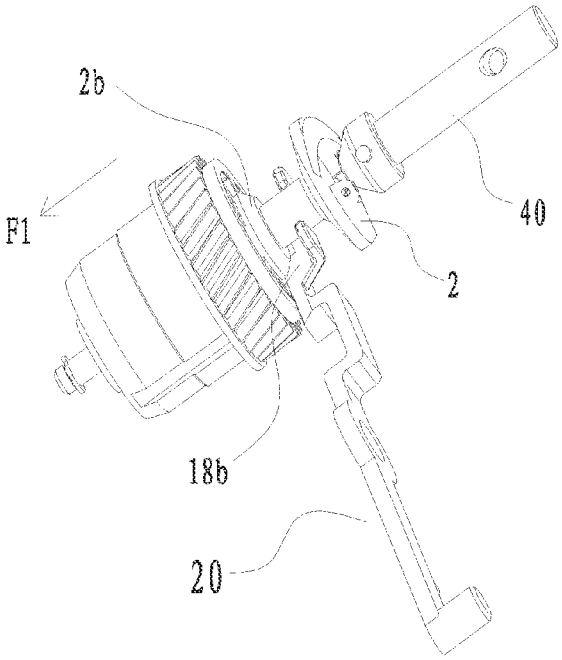
FIG. 6 is a view showing a biasing portion on a control mechanism of the cartridge coupling a slanting surface on a force receiving head when the cartridge is installed in the imaging device.
Figure 7:
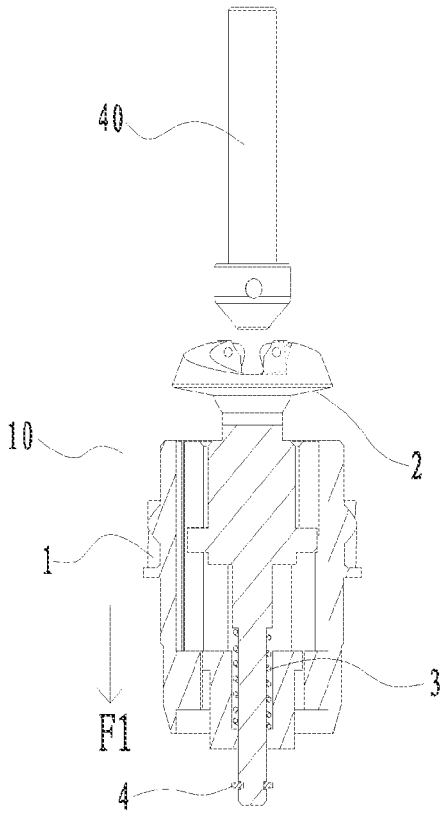
FIG. 7 is a view showing a photosensitive drum driving assembly being separated from a driving head of the imaging device when the cartridge is being installed in the imaging device.
Figure 8:
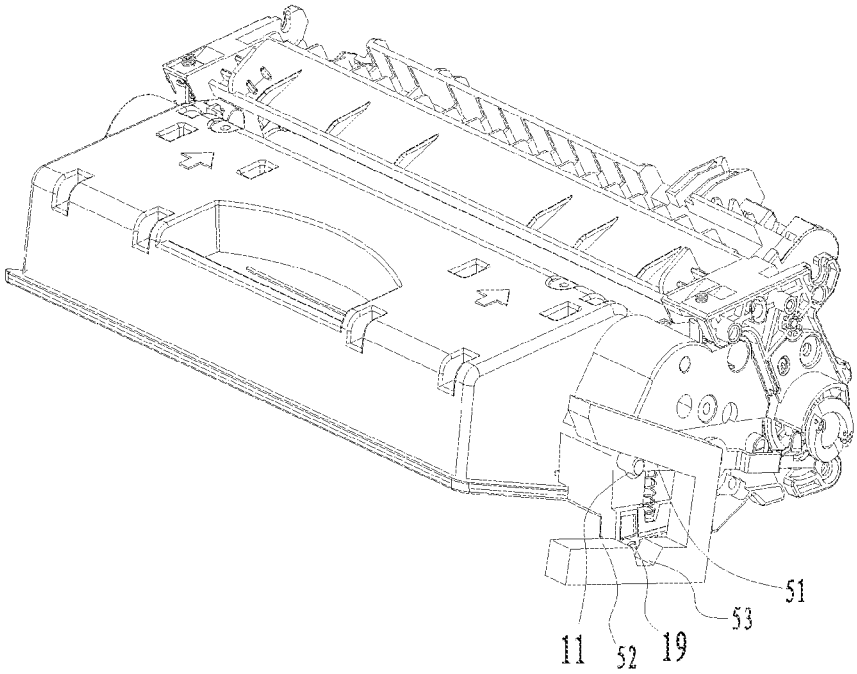
FIG. 8 is a view showing the control mechanism of the cartridge and the restraining portion on the inner wall of the imaging device after the cartridge has been properly installed in the imaging device.
Figure 9:
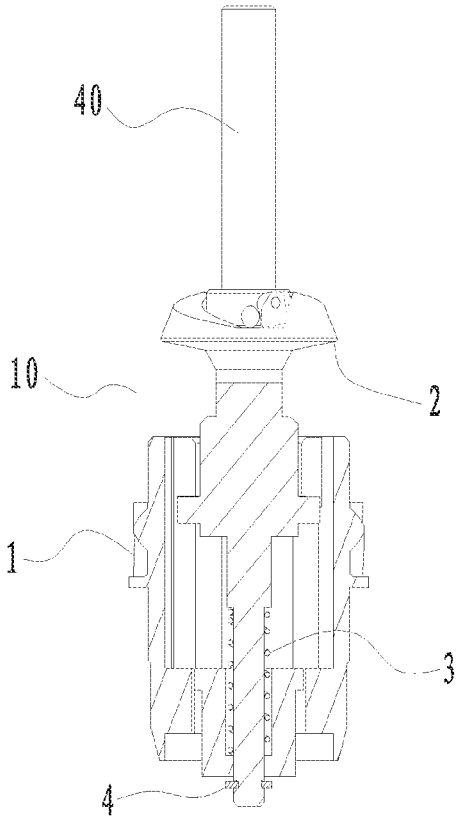
FIG. 9 is a view showing the force receiving head of the photosensitive drum driving assembly joining the driving head of the imaging device after the cartridge has been properly installed in the imaging device.

As shown in FIG. 4 to FIG. 9, when the cartridge according to the invention is installed in the imaging device, the control portion 11 located on the control mechanism 20 of the process cartridge may be forced by the restraining portion 51 on the inner wall of the imaging device (as shown in FIG. 4), so that the control rod 15 of the control mechanism 20 rotates around the positioning column 16 on the side wall of the cartridge body (as shown in FIG. 5). At the same time, a biasing surface 18*b* located on the biasing portion 18 of the control rod couples a slanting surface 2*b* on the force receiving head 2 (as shown in FIG. 6). The coupling between the two surfaces may produce an axial force F1 that drives the force receiving head 2 to retract, which results in avoidance of interference between the force receiving head 2 and the driving head 40 of the imaging device when the cartridge is being installed into the imaging device along a guiding rail 52 thereof (as shown in FIG. 7). When the process cartridge has been properly installed in the imaging device, a guide column 19 of the process cartridge falls into a guide groove 53 of the imaging device (as shown in FIG. 8). At this time, the control portion 11 on the control mechanism 20 of the cartridge is separated from the restraining portion 51 of the imaging device, so that the force receiving head 2 extends along the axial of the drum gear 1 under the elastic resilience of the second biasing means 3 and the first biasing means 14, thus achieving a coupling between the force receiving head 2 and the driving head 40 of the imaging device (as shown in FIG. 9). When the imaging device is powered on, the driving head 40 of the imaging device drives the force receiving head 2 so as to transfer the driving force to the driving system of the cartridge through the force receiving head 2. In this way, the transmission of the driving force of the imaging device is accomplished.

Figure 10:
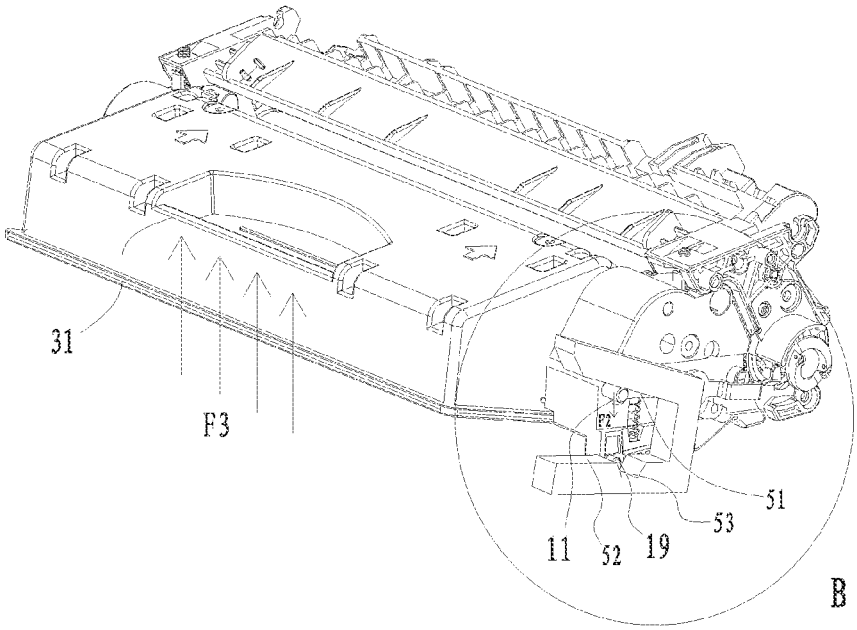
FIG. 10 is a view showing the control mechanism of the cartridge joining the restraining portion on the inner wall of the imaging device when the cartridge is about to be removed from the imaging device.
Figure 11:
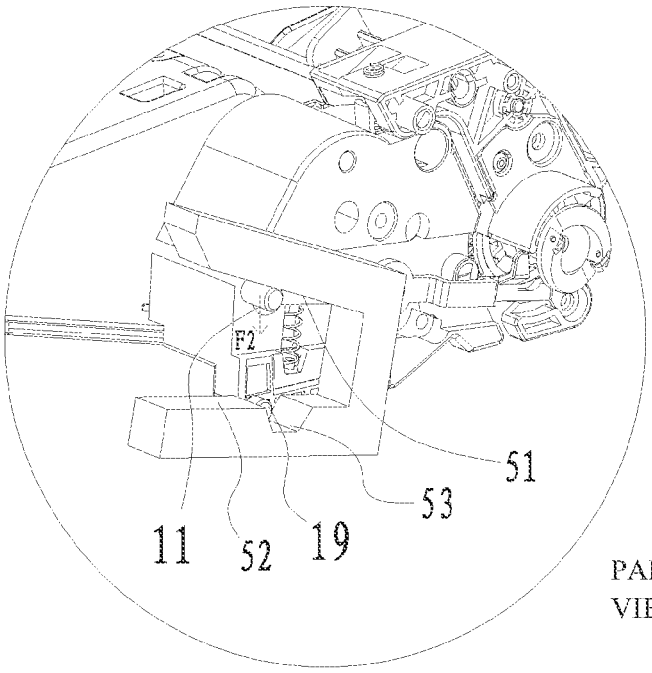
FIG. 11 is a partial enlarged view of part B as shown in FIG. 10.
Figure 12:
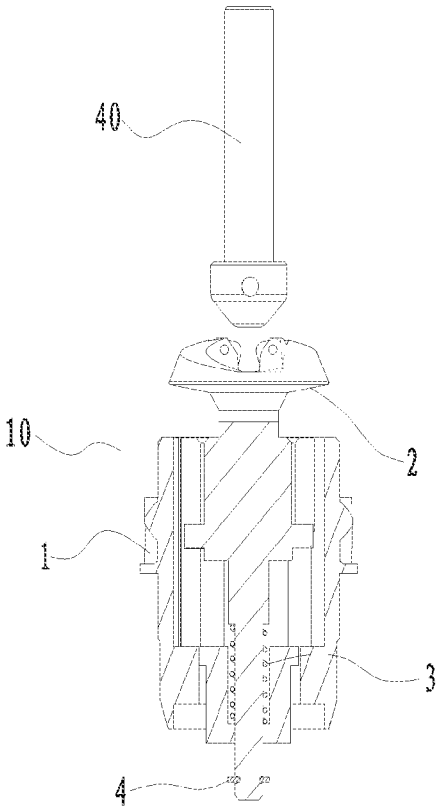
FIG. 12 is a view showing the force receiving head of the photosensitive drum driving assembly being separated from the driving head of the imaging device when the cartridge is being removed from the imaging device.

As shown in FIG. 10 to FIG. 12, a user can lift the cartridge located in the imaging device upwardly along the direction F3 from a handle 31 of the cartridge to take the cartridge out of the imaging device after printing jobs have been completed (as shown in FIG. 10). At this point, the control portion 11 on the control mechanism 20 is subjected to a pressure F2 from the restraining portion 51 on the inner wall of the imaging device (as shown in FIG. 11), so that the control rod 15 of the control mechanism 20 rotates around the positioning column 16 on the side wall of the cartridge casing. The biasing surface 18*b* of the biasing portion 18 of the control rod will then couple the slanting surface 2*b* on the force receiving head 2. The coupling between the two surfaces may produce an axial force that drives the force receiving head 2 to retract, thus allowing the force receiving head and the driving head 40 of the imaging device to be separated. The cartridge of the invention can therefore be conveniently removed from the imaging device along the guiding rail 52 thereof.

When the cartridge of the invention has been taken out of the imaging device, the control rod 15 in the control mechanism 20 may rotate clockwise around the positioning column 16 on the cartridge body under the elastic resilience of the first biasing means 14, so that the pressing force applied by the biasing surface 18*b* of the biasing portion 18 on the force receiving head 2 is removed. The force receiving head 2 located in the photosensitive drum driving assembly 10 may then extend under the elastic resilience of the second biasing means 3, the photosensitive drum driving assembly then returns to a state same as before the cartridge is installed in the imaging device.

Hereinabove, it is discussed preferred embodiment for illustrating the present invention only, but is not meant to limit the present invention. Although the present invention has been described in details by reference with the embodiment as above, it should be understood that a skilled person can appropriately modify the technical solutions illustrated in the above embodiment or substitute partial technical features with equivalents. For example, in the embodiments, the positioning column 16 of the control mechanism 20 is arranged on the cartridge casing and the positioning hole 17 is arranged on the control rod 15. Understandably, the positioning column 16 may alternatively be arranged on the control rod and the positioning hole 17 may be provided on the cartridge casing. Any simple modifications or equivalents based on the principle of the invention are within the scope of the invention.

The invention claimed is:

1. A process cartridge detachably installed to an image forming device, comprises:

a cartridge casing;

a photosensitive drum driving assembly located on the casing; and a control mechanism for controlling extension and retraction of a force receiving head in the photosensitive drum driving assembly, wherein the control mechanism includes a control rod rotatable about a pivot on the cartridge casing and a elastic means mounted on the control rod.

2. A process cartridge according to claim 1, wherein the pivot is a positioning column arranged on a side wall of the cartridge casing, and wherein the control rod is provided with a positioning hole corresponding to the positioning column.

3. A process cartridge according to claim 1, wherein the pivot is a positioning hole arranged in a side wall of the cartridge casing and the control rod is provided with a positioning column corresponding to the positioning hole.

4. A process cartridge according to claim 1, wherein the control rod is provided with a biasing portion for coupling the force receiving head and a control portion for coupling a restraining portion on an inner wall of the imaging device.

5. A process cartridge according to claim 4, wherein the force receiving head is provided with a slanting surface, and wherein the biasing portion is provided with a biasing surface for imposing a biasing force on the slanting surface.

6. A process cartridge according to claim 1, wherein both ends of the elastic means are respectively mounted on a column of the control rod and a column of the cartridge body.

7. A process cartridge according to claim 5, wherein the elastic means is a compression spring.

8. A process cartridge according to claim 2, wherein the control rod is provided with a biasing portion for coupling the force receiving head and a control portion for coupling a restraining portion on an inner wall of the imaging device.

9. A process cartridge according to claim 3, wherein the control rod is provided with a biasing portion for coupling the force receiving head and a control portion for coupling a restraining portion on an inner wall of the imaging device.

10. A process cartridge according to claim 8, wherein the force receiving head is provided with a slanting surface, and wherein the biasing portion is provided with a biasing surface for imposing a biasing force on the slanting surface.

11. A process cartridge according to claim 9, wherein the force receiving head is provided with a slanting surface, and wherein the biasing portion is provided with a biasing surface for imposing a biasing force on the slanting surface.

12. A process cartridge according to claim 10, wherein the elastic means is a compression spring.

13. A process cartridge according to claim 11, wherein the elastic means is a compression spring.

* * * * *